US007007390B2

(12) United States Patent
Mislove

(10) Patent No.: US 7,007,390 B2
(45) Date of Patent: Mar. 7, 2006

(54) WATER IRRIGATED AND ARTICULATED RAZOR

(76) Inventor: Bradley Mislove, 281 S. Hollybrook Dr. #101, Pembroke Pines, FL (US) 33025

( * ) Notice: Subject to any disclaimer, the term of this patent is extended or adjusted under 35 U.S.C. 154(b) by 283 days.

(21) Appl. No.: 10/659,520

(22) Filed: Sep. 10, 2003

(65) Prior Publication Data

US 2005/0050731 A1 Mar. 10, 2005

(51) Int. Cl.
*B26B 21/40* (2006.01)

(52) U.S. Cl. ..... 30/41.5; 30/41; 30/123.3
(58) Field of Classification Search ..... 30/41, 30/41.5, 123.3, 526, 527, 34.05, 537
See application file for complete search history.

(56) References Cited

U.S. PATENT DOCUMENTS 4,177,556 A * 12/1979 Galli, Jr. ..... 30/41
4,205,441 A * 6/1980 Turner ..... 30/41.5
4,228,586 A * 10/1980 Thierry ..... 30/41
4,370,807 A * 2/1983 O'Neill ..... 30/41.5
4,633,585 A * 1/1987 Whitaker et al. ..... 30/41
4,733,468 A * 3/1988 Zadro ..... 30/34.05
5,038,472 A * 8/1991 Iderosa ..... 30/527
5,177,870 A * 1/1993 Jursich et al. ..... 30/41
5,402,697 A * 4/1995 Brooks ..... 83/18
5,678,316 A * 10/1997 Althaus et al. ..... 30/527

* cited by examiner

*Primary Examiner*—Hwei-Siu Payer
(74) *Attorney, Agent, or Firm*—I. Michael Bak-Boychuk

(57) ABSTRACT

An irrigated razor includes a resilient, hollow handle terminating in a transverse head piece provided with a slot wherein razor blades are mounted and exposed to the exiting water flowfrom the handle. The surfaces of the handle subjacent the head piece are folded into adjacent accordion folds which in response to pressure pulses in the handle articulate the blades over the skin of the user. Either a pulsating shower head branched from the water flow to the handle or a pulse mechanism directly in the flow provide the necessary pressure fluctuations.

9 Claims, 3 Drawing Sheets

WATER IRRIGATED AND ARTICULATED RAZOR

BACKGROUND OF THE INVENTION

1. Field of the Invention

The present invention relates to shaving devices, and more particularly to water irrigated shavers modulated in their shaving contact by pulsations in the water stream.

2. Description of the Prior Art

The early morning shower ablution followed by a shave is a well practiced process now wholly imbedded in our everyday life. Even our colloquial discourse includes reference to the proverbial "quick shower and shave" fixing the association of the shower with a subsequent shave. This traditional morning sequence is thus virtually universal as the physics that governs this sequence rest on shaving convenience of the prior day's beard growth that has been first well soaked in the shower. Our colloquial expression simply recognizes that a close shave is much more easily obtained if the face is first well moistened.

In the past various mechanisms have been devised which recognize this relationship and in one way or another irrigate the shaving head with household water flow. The teachings of U.S. Pat. No. 4,633,585 to Whitaker, et al., for example, illustrate one such structure in which the household water supply is conveyed by flexible tubing to irrigate both the shaved surface and also the shaving edges. Other similar examples can be found in U.S. Pat. No. 4,228,586 to Thierry; U.S. Pat. No. 5,177,870 to Jursich, et al.; U.S. Pat. No. 5,402,574 to Milner; U.S. Pat. No. 6,305,082 to Troncoso; and others. Each of the foregoing, while suitable for their purpose, fail to address the coincident steam and moisture that is associated with the irrigation and that also limits the usefulness of a mirror therewith. The user of such irrigated devices is therefore left more or less blind while shaving in the shower and the efficacy of the shaving stroke is therefore a major concern.

Reliance on manual dexterity and control while manipulating a sharp instrument in the steamy confines of a shower and in the consequent absence of all visual feedback is a brave undertaking. For these reasons the prior art irrigated shavers have had less than full acceptance in the marketplace. Instead water impervious motorized shavers appeared on the market, preferring the safety of a small motorized stroke over the manual strokes of a blade edge. Water impervious electric shavers, however, are inherently expensive to produce and alternatives therefor have been universally sought. A passive irrigated shaving arrangement utilizing water pressure fluctuations to excite small blade modes of motion can effectively combine the safety of a small shaving stroke with the convenience of unpowered in-shower use and it is one such arrangement that is disclosed herein.

SUMMARY OF THE INVENTION

Accordingly, it is the general purpose and object of the present invention to provide an irrigated shaving structure in which oscillatory blade motion is induced by the irrigating flow.

Other objects of the invention are to provide a shaving structure conformed for connection to a household water supply to develop a pulsed flow across the shaving edges thereof.

Yet further objects of the present invention are to conform an irrigated shaving structure for oscillatory motion response induced by the irrigating flow.

Briefly, these and other objects are accomplished within the first implementation of the present invention by providing a safety razor assembly with a hollow handle connected at one end to a flexible conduit that is then selectively securable at its other end to a branching outlet of a diverter valve interposed between the shower outlet and a shower pulsating spray head on the other diverter branch. The other end of the hollow handle, in turn, connects to a hollow shaving head provided with an exit slot in which one or more shaving blades are mounted, the connection between the handle and the head being formed as an eccentrically convolved surface conformed to impart small pivotal motions to the head in response to pressure fluctuations within the handle interior. The coincidence of these small pivotal blade motions with each pressure pulse then effects small blade translations over the shaved skin surface that is concurrently under increased irrigation pressure, promoting smooth and effective shaving.

Those skilled in the art will appreciate that the foregoing implementation relies on the pressure fluctuations in the pulsating shower head to produce the reflected pulse pressure in the other diverted branch connected to the inventive shaver. More precisely, a pulsing shower head is usually associated with substantial pressure drops and it is the manual adjustment of these pressure levels that determines the pulse pattern selected. The user thus has substantial control over the amount of the irrigating flow and the pulse pattern by the simple expedient of the diverter valve opening and the selection of the pattern on the shower head.

Of course, for those installations not equipped with a pulsating shower head a pulse adapter can be provided for attachment directly to the end of the hollow shaver handle and implemented in a manner like the pulse generating mechanism of a shower head. This adapter may be vended separately or as part of a combination including the diverter valve, the flexible hose and the inventive irrigated shaver, and may also include various flow rate restrictors useful in accommodating any local water conservation directives. In this manner the full range of shower variants is accommodated in a single vended array.

DESCRIPTION OF THE PREFERRED EMBODIMENTS

Figure 5:
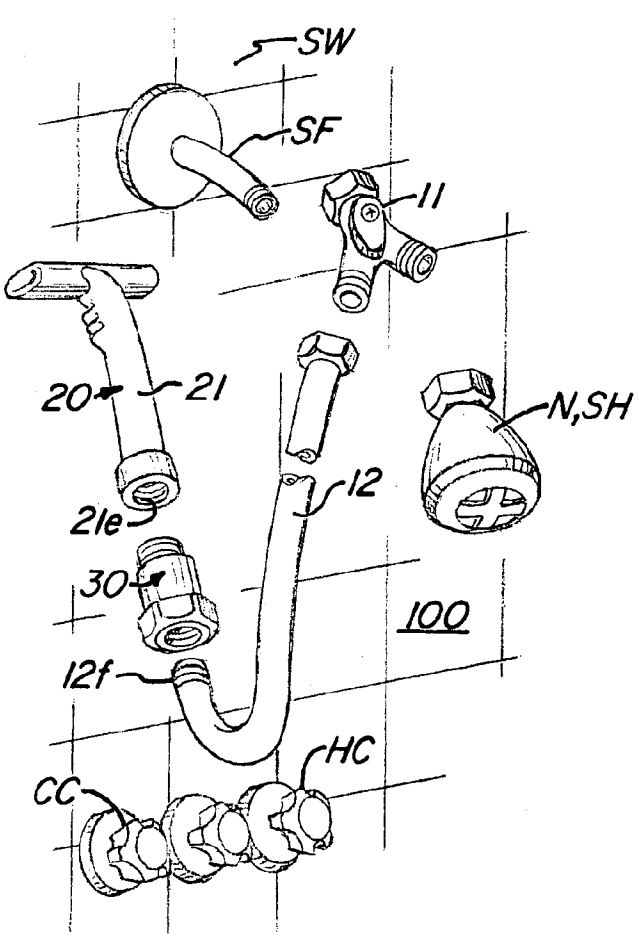
FIG. 5 is yet another perspective illustration, separated by parts, of the inventive shaving assembly conformed for use with an even flow shower head.
Figure 1:
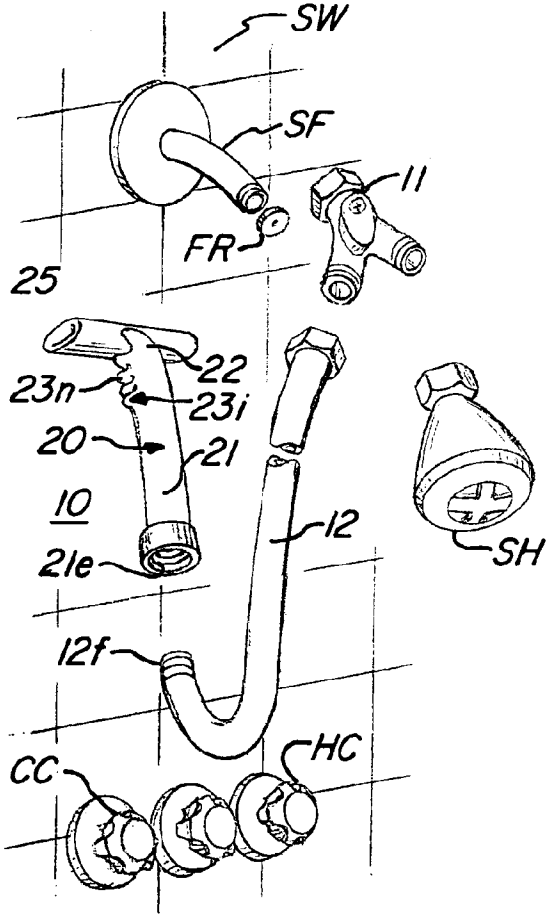
FIG. 1 is a perspective illustration, separated by parts, of the inventive shaving assembly conformed for use with a pulsating shower head.
Figure 4:
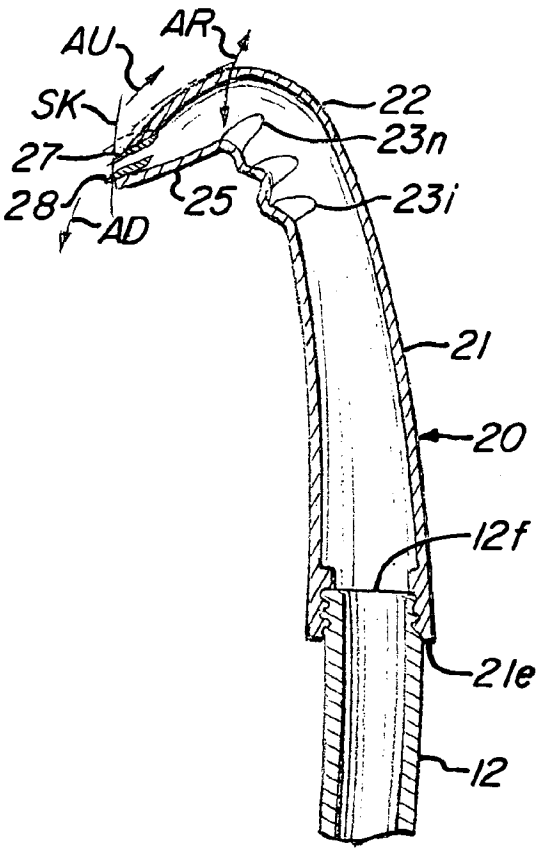
FIG. 4 is a sectional side view taken along line 4—4 of FIG. 2.
Figure 2:
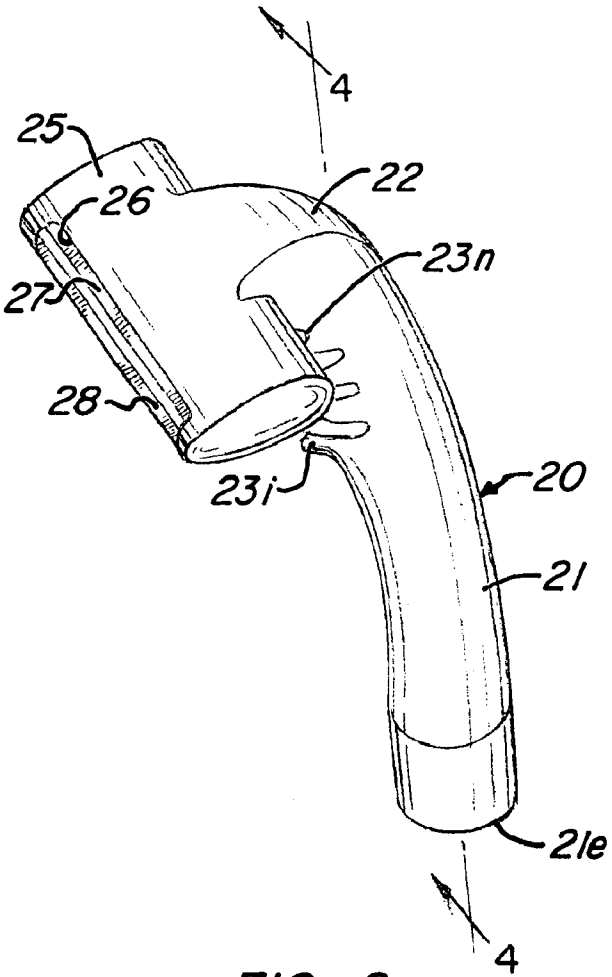
FIG. 2 is yet another perspective illustration of the inventive irrigated shaver useful in the assembly combination shown in FIG. 1 and in other combinations.

As shown in FIGS. 1–4 the inventive irrigated razor shower assembly, generally designated by the numeral 10, is conformed for deployment from a conventional household shower facility including a shower head fitting SF extending to the exterior of a shower wall SW from a delivery pipe DP mounted within the wall and connected at its other end both to a hot and cold water supply HW and CW respectively. In conventional practice manual control devices HC and CC are provided that extend again to the exterior of the shower wall, sometimes in the form of a single manual control device and on other occasions as a set of manual handles, and it is through these devices that the household user selects both the shower flow rate and its temperature. A conventional shower head SH threadably mounted on the end of fitting SF and sometimes fitted with a flow restrictor FR for conservation then dispenses the water flow as a spray onto the user, with the more current shower heads providing a pulsating flow pattern at adjustable pressure fluctuations.

Those skilled in the art will appreciate that the foregoing shower configuration is particularly conformed for interchange and replacement of the shower head SH by the household occupant and this replacement is a relatively frequent event in our everyday life. In consequence the threaded engagement of the shower head SH to the end of the outlet fitting SF is generally straight-forward, conveniently effected with minimal tools. This convenience is used to advantage in the course of installation of the inventive irrigated razor shower assembly 10 in which the shower head SH is first removed from the fitting SF and a diverter valve 11 is then inserted therebetween, with one of the two outlets of valve 11 thereafter re-engaging the shower head while the other outlet is then threadably engaged to one end of a flexible hose 12. Of course, any flow restrictors FR that may have been deployed in the shower head inlet are then re-inserted between the fitting SF and the corresponding inlet of the diverter valve 11 to restore the conservation features earlier installed both through the shower head SH and the flexible hose 12.

The other free end 12*f* of flexible hose 12 is then available for threaded insertion into the end opening 21*e* of a hollow handle 21 forming the inventive irrigated razor 20 formed of a polymeric material structure that is generally elastically resilient. The other end of handle 21 then forms a bent neck portion 22 with the inside surface of the bend convolved in the manner of a plurality of accordion-like folds 23-l through 23-*n* that extend asymmetrically over a part of the inner circumference and as result of this asymmetric geometry impart an arcuate flexure response AR to neck 22 with internal pressure fluctuations. In consequence, a hollow shaving head 25 cantilevered from the neck 22 is also articulated by small articulations AU and AD in the up and down directions respectively. Of course, these up and down articulations correspond directly to an increase and decrease in the in the razor's internal pressure. A set of shaving blades 27 and 28 installed in an end slot 26 of the shaving head 25 is thus articulated in small up and down motions over the skin SK of the user.

It will be appreciated that the pressure fluctuations within razor 20 are a reflection of the flow rate selected by the controls HC and CC, the pressure fluctuations in the shower head SH, the manual setting of diverter valve 11 and the flow restriction through slot 26. The user, therefore, has the full range of controls to select the pressure pulse and the irrigating flow over blades 27 and 28, thus controlling the lubricating irrigation flow pressure against the skin SK during the upward stroke AU. The reduced pressure that then follows allows a further inward extension of the local skin SK into slot 26, resulting in a closer shave stroke in the direction AD. In this manner a convenient stroke articulation is provided that, because of the very limited dimensions of the pressure induced stroke, requires little visual assistance. Thus an inexpensively fabricated hollow razor assembly effectively duplicates the conveniences of a water impervious motorized shaver, providing the further conveniences of easy replacement of those parts of the array that become dull with use.

Figure 6:
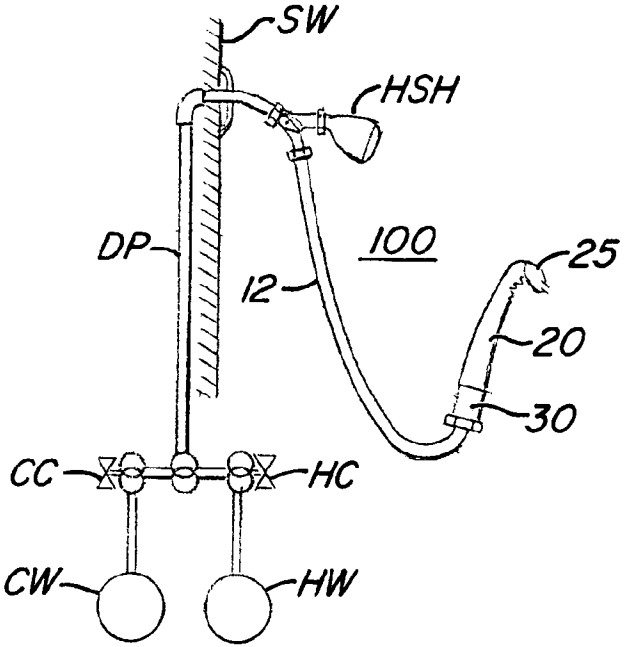
FIG. 6 is a further flow diagram illustrating the water flow conveyances and paths within the inventive assembly shown in FIG. 5.
Figure 3:
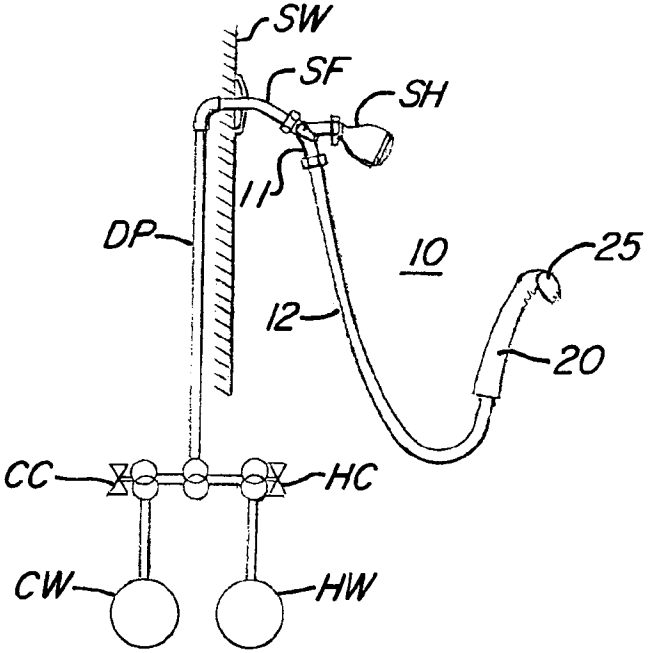
FIG. 3 is a flow diagram illustrating the water flow conveyances and paths within the inventive assembly shown in FIG. 1.

While the foregoing description illustrates the operative aspects of the invention in conjunction with a pulsating shower head SH those skilled in the art will appreciate that similar advantages can be obtained by way of a pulse mechanism 30 between hose 12 and handle 21. By particular reference to FIGS. 5 and 6, wherein like numbered parts function in like manner to that previously described, the inventive shaving assembly 100 may be utilized with a non-pulsing shower head NSH which again is mounted on one branch of diverter valve 11. The other branch, as before, is connected to the flexible hose 12 that then threads at its free end 12*f* to the pulse mechanism 30 and it is the pressure modulated output of the pulse mechanism that then feeds directly into the end opening 21*e* of handle 21. The inventive irrigated razor assembly 20 then operates again in the above manner.

In both implementations the water pressure pulsing mechanism itself may be conformed in accordance with well known teachings in the prior art. For example both the shower head SH and the pulse mechanism 30 may be implemented in a manner like that described in U.S. Pat. No. 4,089,471 issued to Koenig on May 16, 1978 in which balls spaced by circular segments are rotated inside an annular cavity to periodically interrupt the water flow though an opening, or alternatively according to the teachings of U.S. Pat. No. 4,081,135 issued to Tomaro on Mar. 28, 1978 wherein a water driven turbine periodically advances vanes across the water jet to open and close the water flow therethrough. These and similar teachings are well known in the art, each in one manner or another resulting in a pulsating water flow which either directly, or by reflection, then produces the pressure pulses in the irrigated razor 20.

Figure 7:
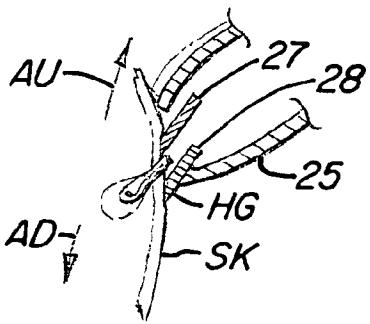
FIG. 7 is a detail illustration, in section, of the coordination of the inventive razor stroke with the local skin deformation.

By particular reference to FIG. 7, those skilled in the art will appreciate that the downward articulation AD of the razor head and the blades mounted therein is associated with a reduction in internal pressure and therefore an extension of the skin SK into an outwardly bulging skin distortion SKI to provide a more intimate contact with the blade edges and therefore a deeper incision into the hair growth HG. Of course, while these effects are both enlarged and exaggerated in the instant illustration this stepwise articulation of the blades in coordination with the pressure pulse results in a closer shave and also one that requires less visual attention because of the small dimensional limits of the strokes AU and AD. In this manner a safe and effective razor is devised that is wholly useful in a shower.

Obviously, many modifications and variations can be effected without departing from the spirit of the invention instantly disclosed. It is therefore intended that the scope of the invention be determined solely by the claims appended hereto.

It is claimed:

1. An irrigated razor assembly, comprising in combination:

a generally cylindrical hollow razor defined by a tubular handle communicating at one end thereof with the interior of a transverse head structure, said head structure including an exit slot provided with one or more blades, said handle including a plurality of surface folds deployed eccentrically adjacent said exit slot for effecting flexing deformation of said handle in response to pressure pulses within the interior of said handle; and water conveying means connected to the other end of said handle for conveying water at pulsating pressure thereto.

2. The razor assembly according to claim 1, wherein:

said folds are conformed as adjacently spaced accordion shaped surface deformation in the wall surface of said handle.

3. The razor assembly according to claim 2, wherein:

said conveying means includes a diverter valve connected to a shower water source and to a pressure pulsating shower head.

4. The razor assembly according to claim 2, wherein:

said conveying means further includes pressure modulating means for producing said pulses in the course of conveying said water to said handle.

5. The razor assembly according to claim 3, wherein:

said diverter valve includes adjustment means for controlling the division of the water flow between said conveying means and said pulsating shower head.

6. An irrigated razor assembly conformed for attachment to the water outlet for a shower head, comprising in combination:

a cylindrical hollow razor defined by a generally tubular resilient handle terminating at one end thereof with the interior of a transverse head structure provided an exit slot supporting therein one or more blades, said handle including a plurality of surface folds deployed eccentrically subjacent said exit slot for effecting flexing deformation of said handle in response to pressure pulses within the interior thereof;

a flexible water conveyance connected between the other end of said handle and a shower water outlet; and means for producing pulsating water pressure within said conveyance and said handle connected thereto.

7. The razor assembly according to claim 6, wherein:

said means includes a diverter valve connected to a shower water source and to a pressure pulsating shower head.

8. The razor assembly according to claim 6, wherein:

said conveying means further includes pressure modulating means for producing said pulses in the course of conveying said water to said handle.

9. The razor assembly according to claim 7, wherein:

said diverter valve includes adjustment means for controlling the division of the water flow between said conveying means and said pulsating shower head.

* * * * *